United States Patent [19]

Ida

[11] 4,078,357

[45] Mar. 14, 1978

[54] METHOD AND APPARATUS FOR INSERTING AND FASTENING AN ADHESIVE-COATED RING INTO A GROUP OF FOUR CANS

[75] Inventor: Noble N. Ida, Boulder, Colo.

[73] Assignee: Eco-Pak Corporation, Littleton, Colo.

[21] Appl. No.: 759,356

[22] Filed: Jan. 14, 1977

[51] Int. Cl.[2] ..... B65B 15/00; B65B 17/02

[52] U.S. Cl. ..... 53/26; 53/48; 53/159; 53/196; 156/561

[58] Field of Search ..... 53/3, 26, 48, 159, 196, 53/197, 128; 156/556, 557, 559–561, 566, 228, 295

[56] References Cited

U.S. PATENT DOCUMENTS

| | | | |
|---|---|---|---|
| 3,096,575 | 7/1963 | Cook | 53/48 X |
| 3,206,020 | 9/1965 | Billingsley et al. | 53/48 X |
| 3,330,402 | 7/1967 | Schlueter | 53/48 X |
| 3,336,723 | 8/1967 | De Shazor | 53/48 X |

*Primary Examiner*—Robert Louis Spruill
*Attorney, Agent, or Firm*—Edwin L. Spangler, Jr.

[57] ABSTRACT

This invention relates to a novel method for detachably fastening cylindrical cans together in assembled relation which includes mounting a generally rectangular ring-like insert on a compressible pick-up member carried by a mandrel preparatory to applying an adhesive to the exterior insert surfaces, arranging the cans in groups of four or six defining an open rectangular array, inserting one or more mandrels carrying precoated inserts into the center of the array, closing the array so as to press the adhesive-coated portions of the inserts into concave engagement with the can walls as they compress the mandrel pick-ups, and withdrawing the mandrel once the adhesive has set. The invention also encompasses the apparatus for carrying out the foregoing method which includes a conveyor having provision for arranging and temporarily holding a group of four or more cans in spread array while adhesive-coated inserts are placed therebetween and then closing the array thereagainst to fasten the inserts thereto preparatory to stripping them from their mandrels. The apparatus also includes a rotating turret that carries several mandrels that move therewith to various positions and both rotate and reciprocate independently thereof. These mandrels receive the uncoated inserts, rotate them past a source of quick setting adhesive, extend the coated inserts into position between a spread array of cans from either the top or bottom or both, and retract leaving the insert in place between the cans once they have been moved together and the adhesive has set.

29 Claims, 22 Drawing Figures

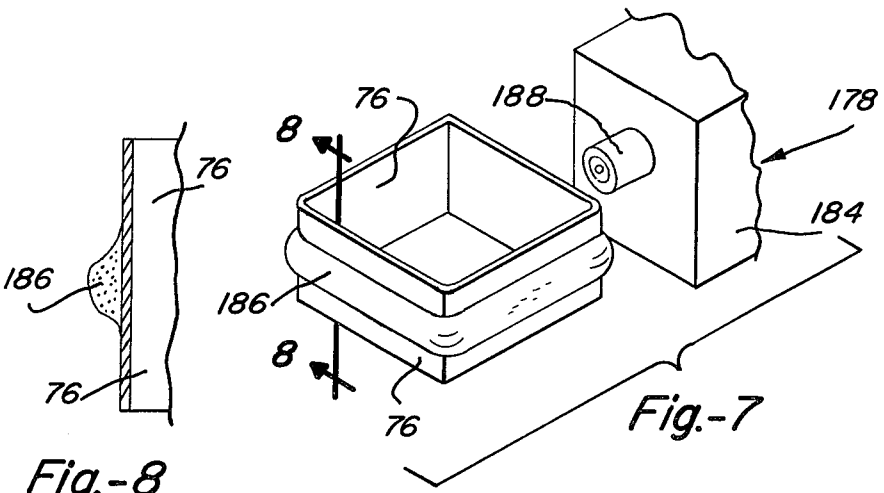
Fig.-7
Fig.-8
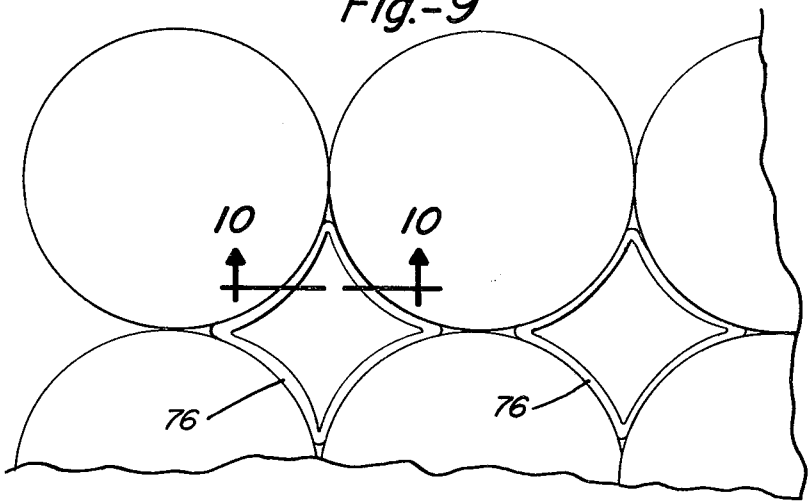
Fig.-9
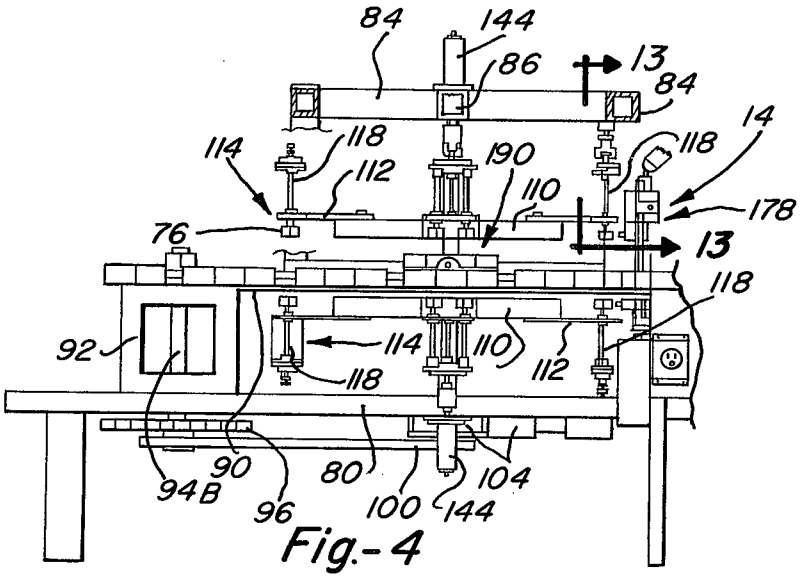
Fig.-4
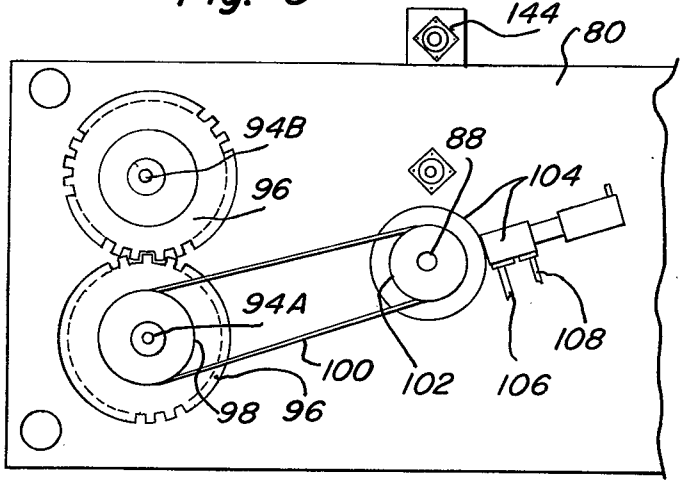
Fig.-6

METHOD AND APPARATUS FOR INSERTING AND FASTENING AN ADHESIVE-COATED RING INTO A GROUP OF FOUR CANS

Several attempts have been made in the past to glue a set of two or more cans together to form a package. Generally, six such cans were joined together in rows of three each in side-by-side contacting relation thus forming a so-called "six-pack". Despite the several obvious economical, environmental and aesthetic advantages to such an approach, up to now at least, it has proven unsatisfactory for a number of reasons, certainly not the least of which is the problem of separating the cans once they have been glued together securely enough to withstand the rigors of shipment and handling.

In an effort to solve the latter problem, the approach has been one of placing a fracturable adhesive-coated pad between the cans and then ripping the pad apart when the time came to separate the cans one from another. U.S. Pat. No. 3,902,992 teaches such an approach. Applicant is also the inventor of an improvement in the latter which employs a generally rectangular ring-like cardboard insert deformable into a four sided polygon having concave arcuate sides mating with the can walls in closed array. It is to the latter construction that the present invention relates and, specifically, to the all important method and apparatus for installing same.

Essential to proper functioning of the insert is the fact that all four of its sides must make substantial area contact with the opposed portion of the can wall. It has been found that rather than preshaping the insert to provide concave arcuate wall surfaces already formed to mate with the cylindrical can wall, the better approach is to leave them essentially flat but back them up with a deformable cushion which will cooperate with said can wall when pressed thereagainst to shape the adhesive-coated insert wall "in situ" therebetween. By so doing, the problems of accurately preshaping the insert and maintaining this shape until it is finally glued to the cans is avoided. Also, the insert is applied under pressure insuring a firm secure bond. Moreover, the deformability of the cushion permits it to conform with any irregularities in the can surface while forcing the adhesive-coated insert wall to do likewise.

The manner in which the adhesive is applied to the insert is also significant because it integrates well with high speed packaging techniques and equipment. In accordance with the teaching of the instant invention, each insert is rotated one complete revolution past a fixed nozzle which dispenses a ribbon or bead of adhesive thereon over the time period required for the mandrel on which the insert is mounted to complete its turn.

Another important feature is the manner in which the cans are collected and handled so that they will be in position for the insert to be placed therebetween. It has been found quite advantageous to arrange the cans in open array that two groups of two or more cans are placed in transversely-spaced parallel relation with the cans of each group being in longitudinally-aligned tangential relation with no gap therebetween. By so doing the groups in open array need only be shifted transversely relative to one another in order to move into closed array against the inserts and cushioned mandrels therebehind. This is a far simpler operation and one much more easily controlled than that of moving some or all of the cans in the array diagonally with respect to their line of travel when going from open to closed array.

Saddles moving with the conveyor and attached thereto hold the cans of each group in aligned contacting relation while cooperating with a retractable spacer to maintain said groups in fixed transversely-spaced relation until the mandrels introduce the adhesive-coated inserts therebetween. Once the inserts are in place, the spacer extracts and at least one, but preferably two, pushers shift the cam groups relative to one another into closed array. While it is possible to hold one group of cams in fixed position and shift the other transversely relative thereto, it is considerably simpler to move both groups toward one another thus eliminating the need to shift the mandrels from side-to-side.

The turret carries the mandrels together with the adhesive-coated inserts into position to enter the space between the groups of cans. If a single set of two inserts are used to hold six cans together in "six-pack" relation, they will ordinarily be introduced from above rather than from underneath. Alternatively, if two sets of inserts are used, one set affixed above center and the other below center, one set will ordinarily be introduced from the top and the second set from the bottom although both sets can be introduced from the same direction by merely mounting two inserts one above the other on the same mandrel.

The pushers move the opposed can groups away from their alignment saddles and hold them together until the adhesive sets, whereupon, the mandrels retract stripping the inserts therefrom. Once the two groups of the open array have closed into side-by-side contacting relation and the inserts are functioning to maintain this condition, the pushers retract and the saddles once again engage the finished assembly, albeit loosely, to move it on out of the way.

Accordingly, it is the principal object of the present invention to provide a novel and improved method for detachably fastening four or more cans together in assembled relation which encompasses inserting into a space left therebetween an adhesive-coated ring like fracturable insert preparatory to moving said cans into a close coupled contacting relation.

A second objective is the provision of a novel apparatus for carrying out the aforesaid method, such apparatus including a cushioned mandrel deformable when the cylindrical can bodies are pressed thereagainst and operative to cooperate therewith in shaping the adhesive-coated walls of the insert so as to conform with cushion deforming surfaces of the can.

Another object of the invention forming the subject matter hereof is to provide a conveyor having means adapted to collect and maintain a group of four or six cans in open array while one or more pre-glued inserts is placed therebetween and then closing the array to complete the connection between the inserts and cans preparatory to stripping the mandrel free thereof.

Still another object is the provision of a can packaging machine which is capable of introducing from top or bottom or both, one or more adhesive-coated inserts into the space between three or more, usually four, rectangularly-grouped cans.

An additional object of the within described invention is to provide a method of forming multi-pack packages of three or more cans that is compatible with existing high speed can-filling and can-handling methods and equipment.

Further objects are to provide a machine for assembling three or more cans into a multi-can pack which is relatively simple, compact, rugged, versatile, efficient, easy to service and maintain, and one that integrates well with existing machinery.

Other objects will be in part apparent and in part pointed out specifically hereinafter in connection with the description of the drawings that follows, and in which:

FIG. 4 is a fragmentary side elevation similar to FIG. 2 and to the same scale but differing therefrom in that the supporting structure has been broken away and shown in section to better reveal the mechanism therebehind;

FIG. 6 is a fragmentary bottom plan view showing the drive mechanism for the mandrel turret to the same scale as FIGS. 1–4;

FIG. 7 is a fragmentary perspective view to a greatly enlarged scale showing in schematic form the manner in which the adhesive is applied to the insert;

FIG. 8 is a still further enlarged section taken along line 8—8 of FIG. 7;

FIG. 9 is a fragmentary top plan view to the same scale as FIG. 7 showing the completed six-pack;

Figure 1:
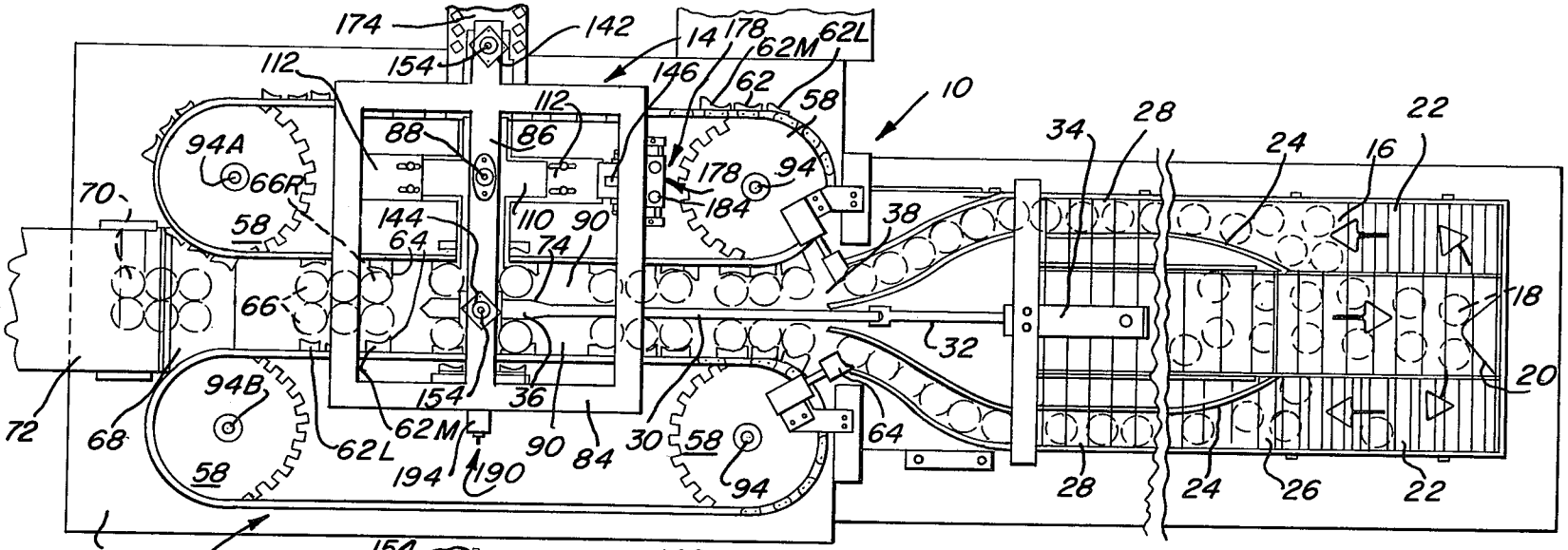
FIG. 1 is a top plan view, portions of which have been broken away to conserve space, illustrating the can-packaging apparatus in its entirety.

Referring next to the drawings for a detailed description of the present invention and, initially, to FIGS. 1–5 for this purpose, reference numeral 10 has been selected to designate the can-packaging machine in its entirety while numeral 12 similarly designates the conveyor subassembly by means of which the cans are gathered and first placed in open array to receive the insert between the transversely-spaced groups thereof and then moved into closed array to strip the inserts from their mandrels. Numeral 14, on the other hand, has been employed to broadly denote the turret subassembly that carries the mandrels and moves them from station-to-station where they pick up the insert, receive the adhesive thereon, place the inserts thus coated between the groups of cans held in open array and, in the particular form shown, they progress to an inactive station preparatory to starting the cycle over again.

Figure 2:
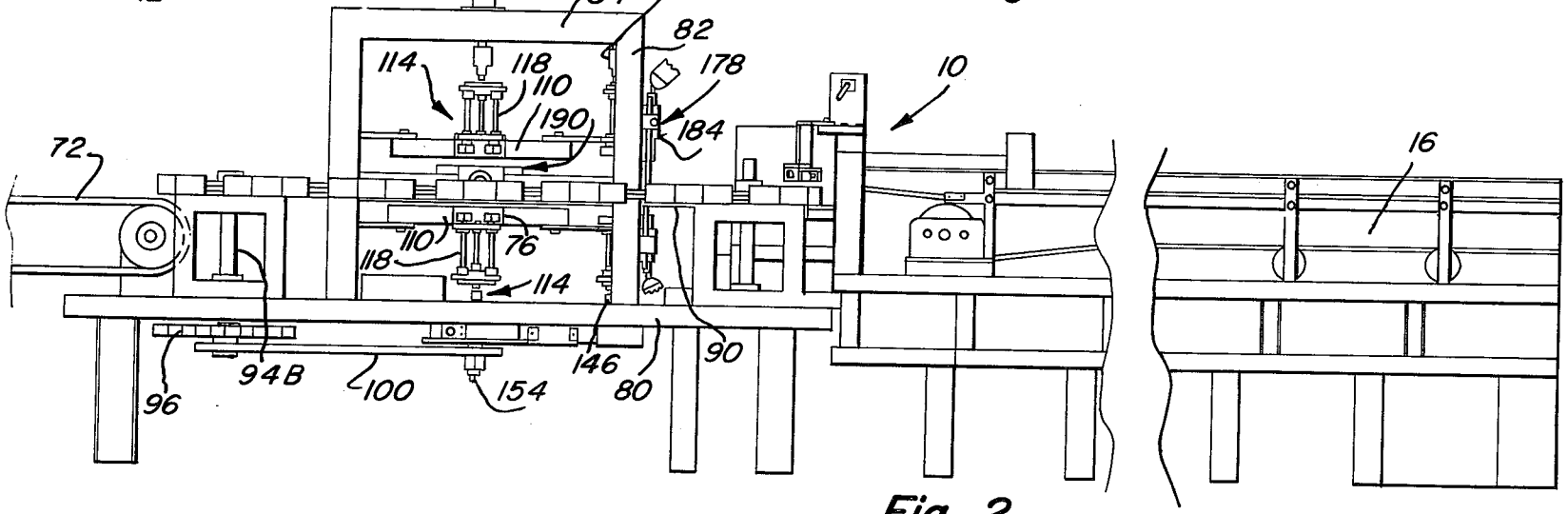
FIG. 2 is a side elevation of the same apparatus shown in FIG. 1 and to the same scale.

Shown in FIGS. 1 and 2 is a standard "lead-in" can conveyor 16 which receives cans on the center section 18 thereof which transports them along until they impinge against a divider element 20 which, as indicated by the curved arrows, is effective to send some of the cans to the right and others to the left. As these cans leave the divider they are picked up by spaced parallel side conveyors 22 that run alongside the center section 18 but in the opposite direction as shown by the straight arrows. A pair of fences 24 on each side conveyor cooperate to define a convergent throat section 26 that merges into a track or guideway 28 which directs and conveys the cans in single file into the subassembly 12 which gathers and collects them into sets of six cans each to be fastened together as a unitary package.

This conveyor subassembly 12 is most clearly revealed in FIGS. 1, 5, 12, 18 an 19 to which detailed reference will next be made. Right and left guideways 28 merge at the entrance to subassembly 12 where they discharge the cans guided therein against a longitudinally-extending divider member 30 which keeps the lines of cans spaced apart slightly in side-by-side parallel relation. This divider is connected to the piston rod 32 of a pneumatic servomotor 34 which is operative upon actuation to extend and retract said divider along with the slightly wider spacer 36 formed on the forward or lead end thereof, the function of which will be set forth in detail presently.

Figure 3:
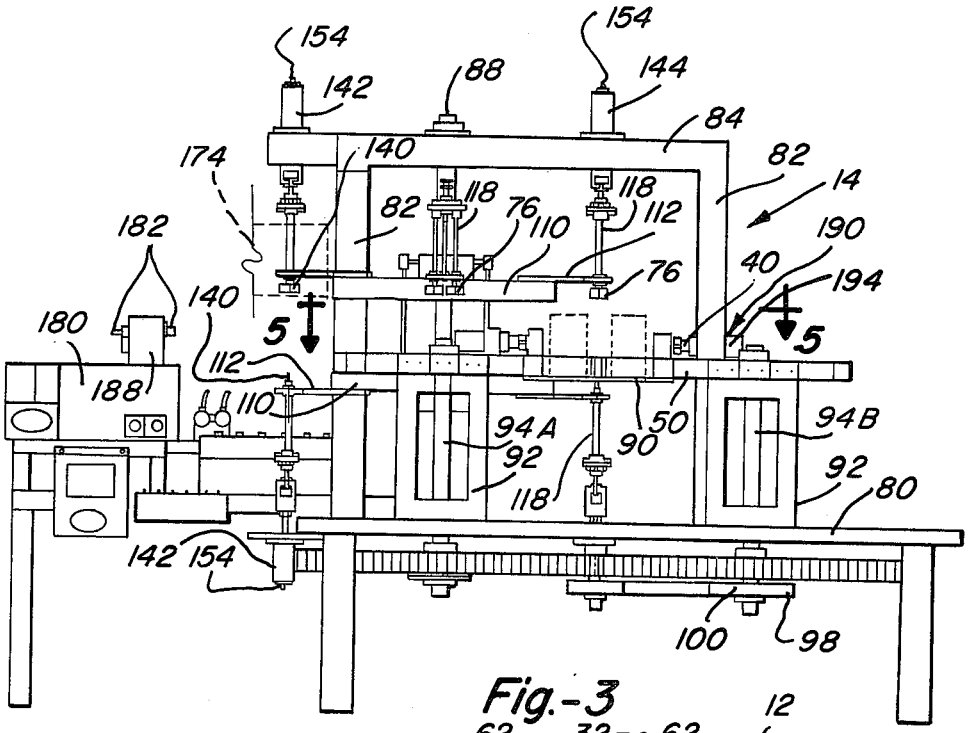
FIG. 3 is an end view of the same scale as FIGS. 1 and 2 showing the apparatus as it would appear looking upstream from the discharge end.
Figure 19:
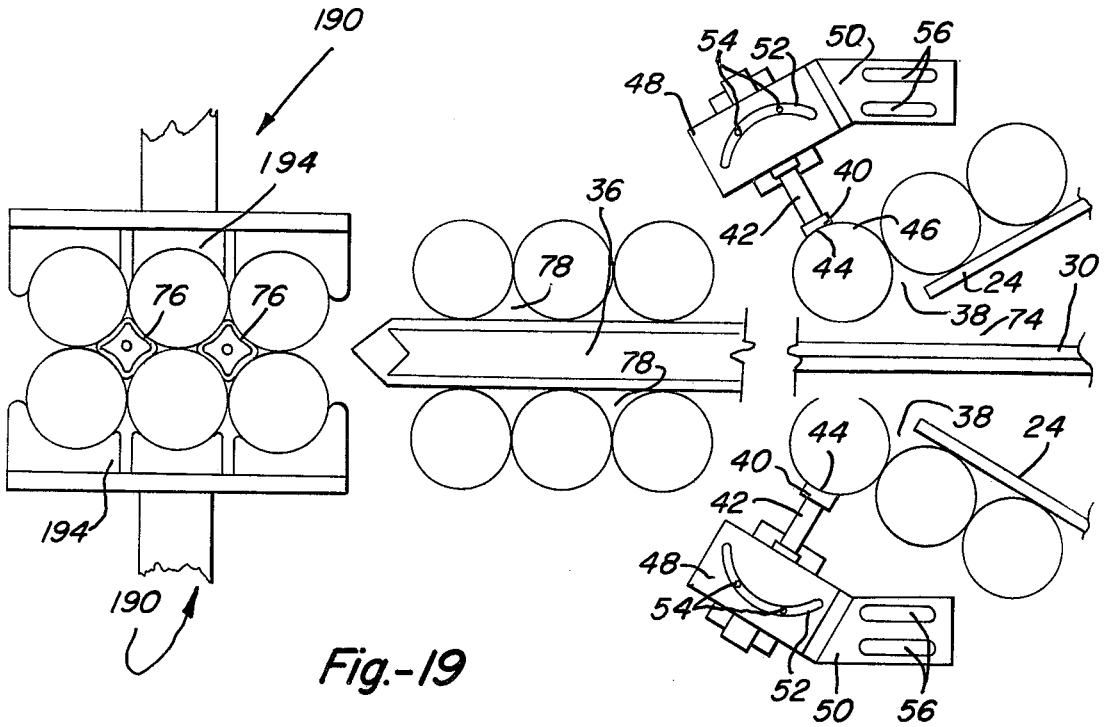
FIG. 19 is a fragmentary bottom plan view like FIG. 18 except that the spreader has been retracted and the pushers have moved the groups into close contacting array.
Figure 18:
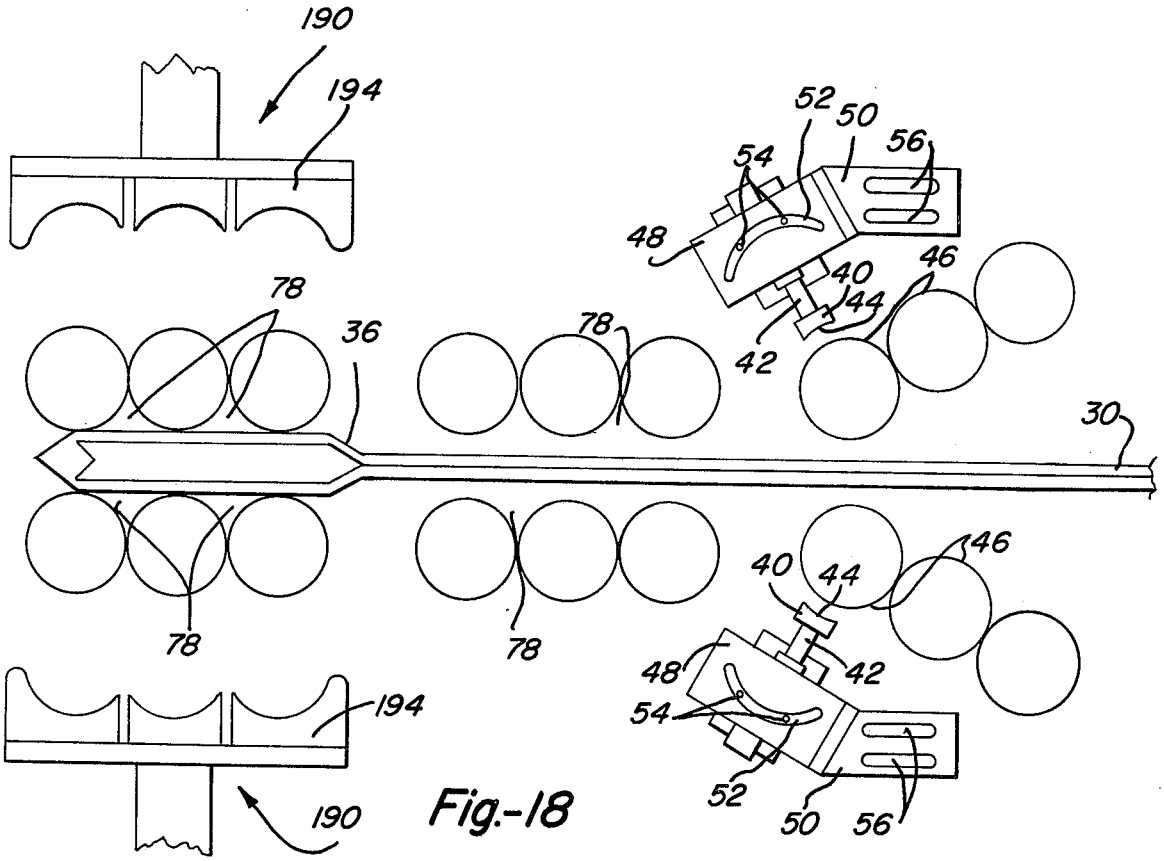
FIG. 18 is a fragmentary bottom plan view to a scale somewhat larger than FIG. 5 showing the can-arranging subassembly of the conveyor which is used to separate the cans in groups of six, arrange them in two groups of three each and hold them in open or spread array.
Figure 20:
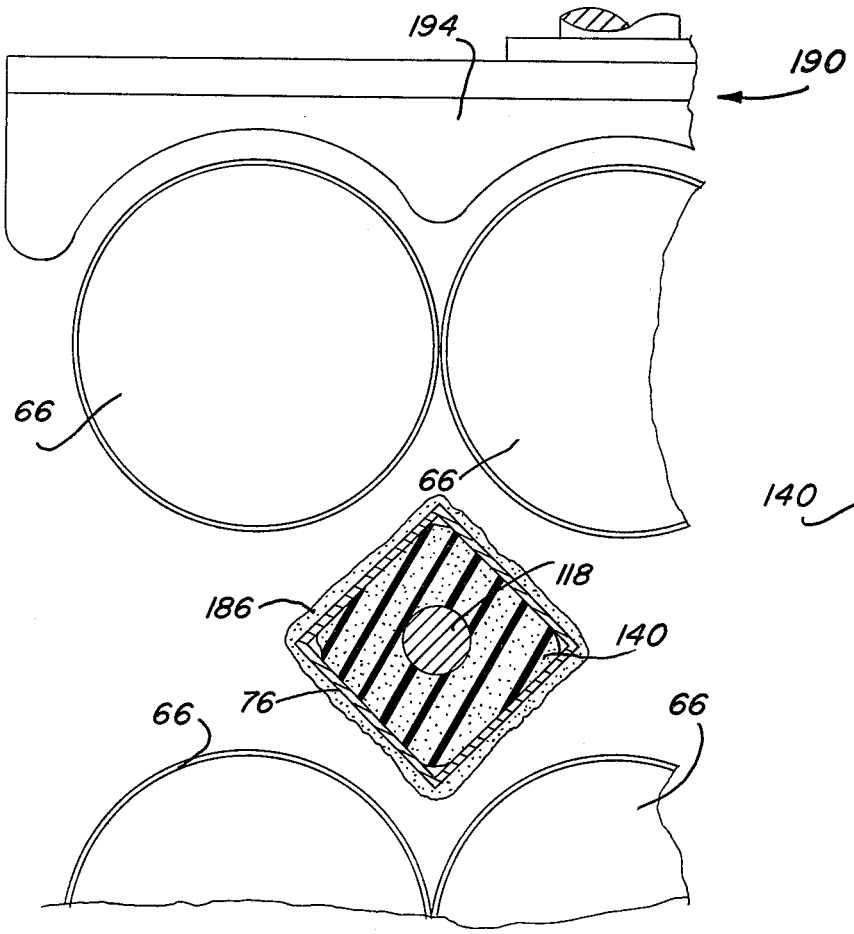
FIG. 20 is a greatly enlarged fragmentary section showing four cans of the groups in open array.

Adjacent the exits 38 are positioned retractable gates 40 which cooperate with the divider 30 in the extended position of said gates shown in FIGS. 1, 3 and 19 to hold back the line of incoming cans entering subassembly 12. These gates comprising small pneumatic servomotors, the piston rods 42 of which extend and retract upon actuation in the usual manner to close and open, respectively, the discharge end or exit from the guideways. Concave generally cylindrical can-engaging shoes 44 are mounted on the ends of the piston rods and are shaped to fit the convex cylindrical can bodies 46 as shown most clearly in FIG. 19. In the particular form illustrated, the servomotor bodies 48 housing the cylinder and piston (not shown) are mounted for arcuate adjustable movement on the mounting bracket 50 as indicated by arcuate slot 52 and fasteners 54. Parallel slots 56 in the bracket similarly mount the servomotor subassembly for limited longitudinal adjustment along the line of can movement.

Referring once again to FIGS. 1–5, it will be noted that a pair of large diameter sprockets 58 are mounted in longitudinally-spaced relation to one side of the divider 30 in position such that the inside run of the sprocket chain 60 reaved therearound passes alongside said divider in spaced substantially parallel relation thereto. A second substantially identical chain and sprocket subassembly is positioned on the opposite side of the divider as shown. As illustrated, three successive links of the chain are equipped with can-engaging saddles 62 while the fourth is left blank. The lead and middle saddle 62L and 62, respectively, are identical while the trailing one 62M is slightly modified to include a projecting lip 64 that defines a pusher effective to engage the rearmost can 66R of each group of three and push them along from the pick-up point just beyond the gates 40 to the discharge end 68 where the completed six-packs 70 are carried off on a conventional conveyor 72.

The sprocket chains 60 are synchronized with one another and with the gates 40 such that the lead saddles 62L are in position to pick up the first cans released when the gates open. The gates are controlled to stay open for the interval required to release a group of three cans on each side of the divider at which point they close again. As will appear presently, the particular form of packaging machine illustrated herein calls for interruption of the flow of cans for the interval required to place the adhesive-coated inserts between the groups of cans in open array, close the groups, withdraw the mandrels and permit the adhesive to set; however, it is certainly within the skill of the art to perform these same operations while the cans continue to move. This could be accomplished, for example, using a rotating turret subassembly not substantially different from the instant one provided, of course, the conveyor moved the cans along a circular path corresponding to that followed by the extended mandrels. The instant system wherein the continued movement of the cans is interrupted for a few seconds to complete the packaging operation has certain advantages over the continuous system, however, primarily from the aspects of simplicity and the greater degree of control one has to adjust for anomalies such as a slow setting batch of adhesive, etc.

This is, perhaps, as good a point as any to point out the rather obvious fact that, while the instant invention has been illustrated as it would be used in making up six-packs, it is equally suitable for use in forming packages containing any even number of cans of four or more. Even three cans will go together so as to leave an enclosed space therebetween into which a triangular, rather than a square, insert of the same type disclosed herein could be introduced; but, as a practical matter, there are few occasions where any commercial packaging operation would want, or need, to fasten only three cans together in a unitary package.

Returning once more to the drawings and this time again to FIGS. 1, 5, 12, 18 and 19, it will be seen that each loop of the sprocket chain conveys successive groups of three cans each along the divider which defines a fence holding these groups in transversely-aligned but spaced relation. As these side-by-side groups move forward along the divider, they are spread slightly farther apart in the particular embodiment illustrated by the inclined cam surfaces 74 located at the junction between the spacer 36 and the divider 30. The only significance of this is that by not squeezing the cans tightly between the saddles 62 and the divider as they slide along the latter, less abrasion is present which might mar the finish. One important advantage of the instant packaging method is, of course, that it leaves the highly decorative exterior surface of the can exposed to view rather than covering it up with some less attractive cardboard or paper wrapper. Once the groups of cans reach the holding station where the sprocket conveyors stop and the actual packaging operation is performed, they must be held sufficiently far apart to admit the adhesive-coated inserts along with the mandrels carrying same therebetween. Such is the function of spacer 36.

All during the time that the cans are being aligned, separated into transversely-aligned groups of three each and held in open array, the turret subassembly 14 and associated appurtenances are preparing the inserts 76 for insertion in the two gaps 78 held open between the groups by spacer 36 as previously noted. The operations by which the inserts are prepared are most clearly revealed in FIGS. 1–4, 6, 7, 8 and 11–16 to which detailed reference will next be made.

Beginning with FIGS. 1–6, it will be seen that the main frame 80 supports four uprights 82 which, in turn, support an overhead subframe 84. These frame elements are designed to cooperate with one another in defining an archway beneath and through which the cans pass on conveyor subassembly 12. A crossframe element 86 extends transversely across subframe 84 in horizontal fixed spaced relation above the cans at the point where they are temporarily stopped and held in open array. Journalled for rotational movement between this crossframe member and the bed of the main frame is a vertically-disposed shaft 88.

The cans are conveyed along a shelf 90 which extends along between the adjacent runs 60 of the sprocket chain. This shelf is raised well above the level of the main frame 80 on suitable supports. Each of the four sprockets 58 is secured to a shaft 94 which extends vertically between the main frame 80 and the top of supports 92 atop which the sprockets are mounted. Two of these shafts, 94A and 94B, carry large meshed ring gears 96 on their lower ends underneath the main frame as revealed most clearly in FIG. 6. Shaft 94A also carries a smaller diameter ring gear 98 which is driven by a belt 100 connected to main drive gear 102 on the lower end of shaft 88. The main drive mechanism 104 is operative upon each actuation to turn shaft 88, gears 96, 98 and 102, all four sprocket gear shafts 94 and the sprockets 58 attached thereto simultaneously through a quarter revolution. Drive mechanism 104 is a commercially available unit sold by Allenair Corporation as its Model 725 Dial Feed Table and Indexing Fixture and, as such, it forms no part of the present invention. It is a hydraulically powered unit, the hydraulic fluid being supplied thereto by hydraulic lines 106 and 108. This unit offers certain advantages in precision positioning of the various elements of the packaging system operatively connected thereto which are difficult to achieve with other systems such as, for example, electric motors operating intermittently and controlled by limit switches, quarter revolution clutches, etc., although other arrangements such as these could be substituted for the one shown. The principal objective of the drive mechanism is, as will appear presently, the accurate and simultaneous positioning of various elements including the workpieces at different stations where certain sequential operations take place and any mechanism including the one illustrated that carry out this function repeatedly, fast and reliably will suffice.

Looking again at FIGS. 1–4, it will be seen that shaft 88 mounts either one or a pair of turrets 110 that rotate therewith into successive operative positions which will be described in detail presently. One such turret is used when only one adhesive-coated insert 76 is going to be introduced between a set of four cans, usually from above but not necessarily so. On the other hand, when two inserts are to be placed between each set of four cans, one near the rim and a second near the base as shown, two such turrets are required, both operating off the same shaft 88.

One of these turrets is positioned on shaft 88 to rotate therewith in spaced relation above the level at which the cans progress through conveyor subassembly 12 while the second turns in a similar position therebeneath as is clearly revealed in FIGS. 1–4. In the particular form shown, these turrets are X-shaped with each having four radially-extending horizontally-disposed arms 90° apart. Slotted mounting plates 112 are provided on the free end of each arm for adjusting the length thereof. These mounting plates support a mandrel subassembly which has been identified broadly by reference numeral 114 and which will be described in detail presently in connection with FIGS. 13 and 17.

Figures 13, 14, 15, 16, 17:
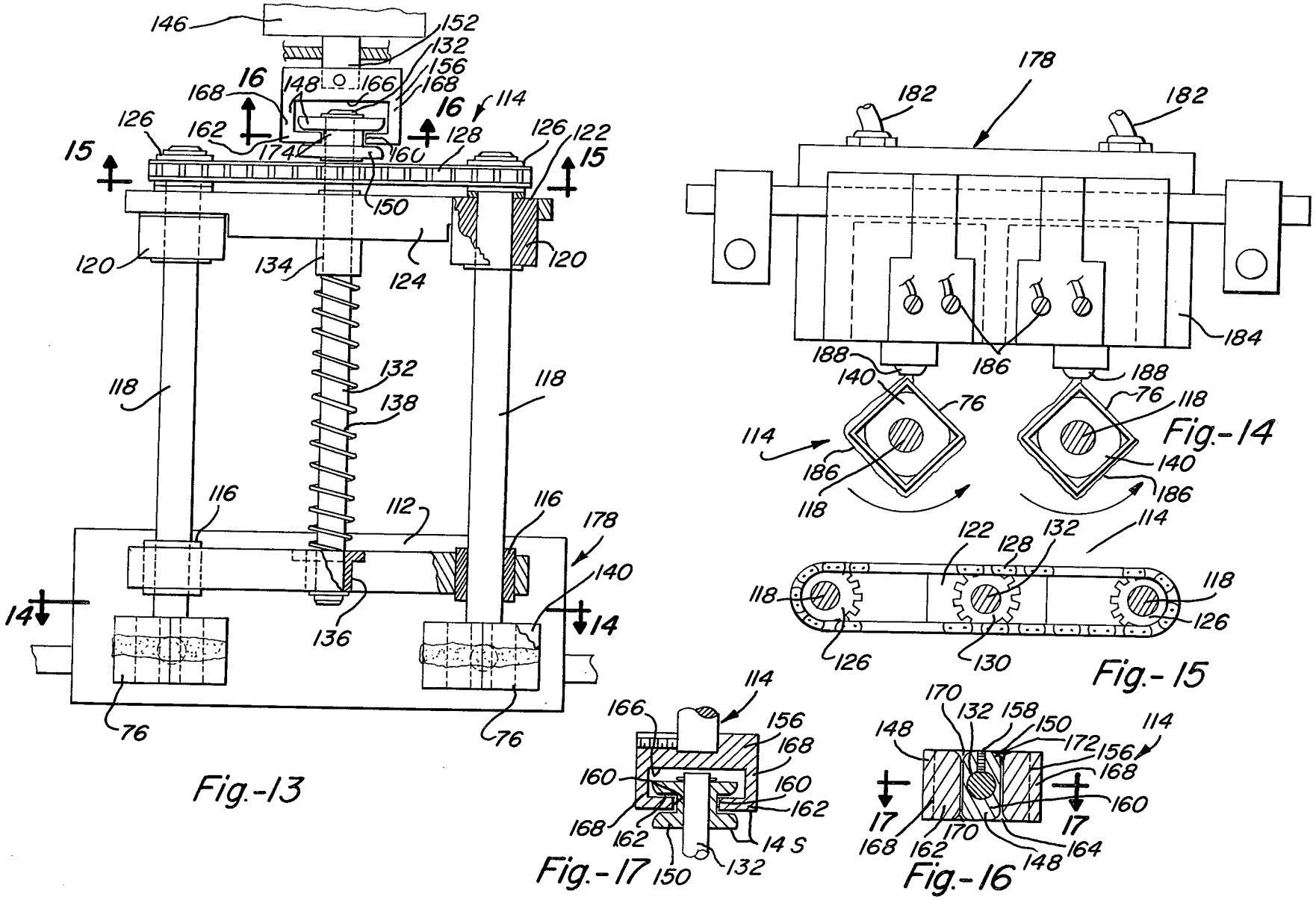
FIG. 13 is a greatly enlarged fragmentary detail, portions of which have been broken away and shown in section, revealing the mandrel subassembly and glue dispensing subassembly.
FIG. 14 is a section taken along line 14—14 of FIG. 13 and to the same scale.
FIG. 15 is a section taken along line 15—15 of FIG. 13.
FIG. 16 is a section taken along line 16—16 of FIG. 13.
FIG. 17 is a section taken along line 17—17 of FIG. 16.

The ends of mounting plates 112 that lie remote from the axis of turret rotation defined by shaft 88 are provided with a pair of transversely-spaced bushings 116 which receive the mandrels 118 for relative rotational and reciprocating motion about a vertical axis lying in fixed spaced parallel relation to said turret axis. A second pair of bushings 120 journal the upper ends of mandrels 118 for rotational movement alone since these mandrels do not reciprocate therein as they do in bushings 116. Bushings 120 are mounted within holes 122 in an apertured yoke 124 extending therebetween. Sprockets 126 are secured to these mandrels in position to rest atop yoke 124 near the ends thereof. Reaves around these sprockets is a chain 128 which also engages a drive sprocket 130 locaed therebetween (FIG. 15). The latter sprocket is fastened to a shaft 132 which is journalled for rotation within a bushing 134 carried by yoke 124 midway between bushings 120. The lower end of shaft 132 is received for both rotational and axial movement in still another bushing 136 located in plate 112 midway between bushings 116. A compression spring 138 on shaft 132 abutting bushings 134 and 136 functions to maintain the mandrels 118 in their normal retracted position shown in FIG. 13. Rotation of shaft 132 will, of course, result in corresponding rotational movement of both shafts 118 due to the operative connection therebetween provided by the chain and sprocket drive. Also, axial movement of shaft 132 will result in the mandrels linked thereto by yoke 124 moving from their retracted positions shown in FIG. 13 into the extended operative positions shown schematically on the righthand side of FIG. 11.

Figure 11:
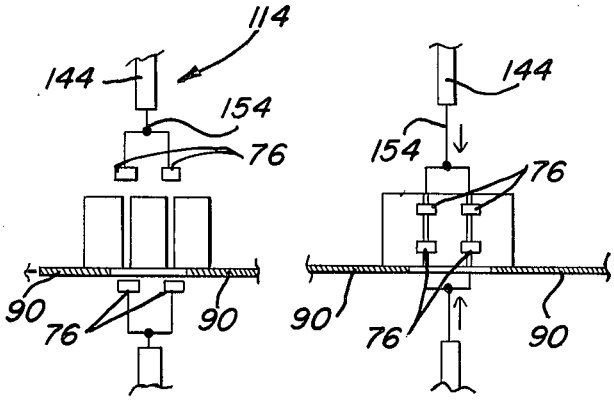
FIG. 11 is a diagram to approximately the same scale as FIGS. 1–4 showing the steps by which the mandrels are moved from retracted into extended position when placing the mandrels between the groups of cans in open array.
Figure 12:
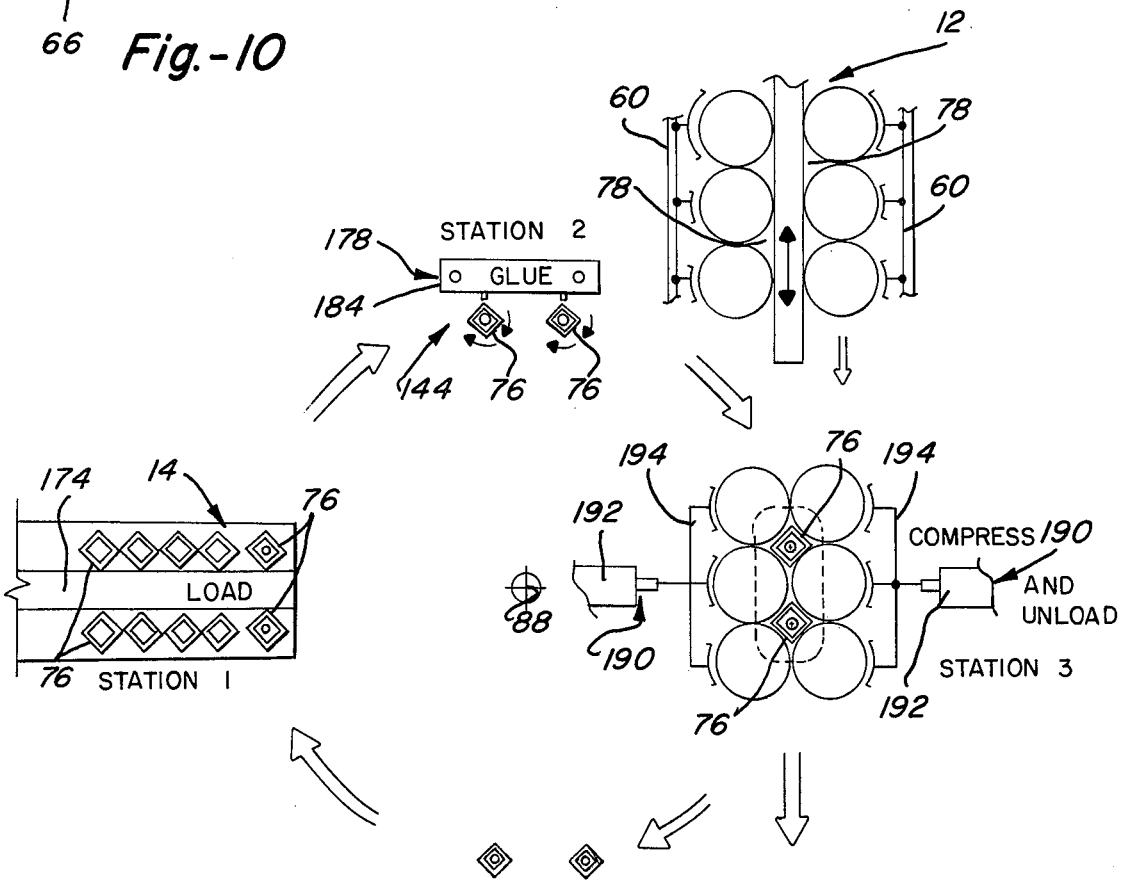
FIG. 12 is a diagram to a slightly larger scale than FIG. 11 illustrating the several successive stages the mandrels move through on its turret in picking up the inserts, receiving the adhesive thereon, installing same and stripping them.

Referring briefly to FIGS. 3, 11 and 12, it will be seen that the turrets 110 move progressively through a series of four stations, only three of which are illustrated as being functional. As such, three operative stations spaced 120° apart angularly would, of course, accomplish the same thing; however, the four station approach has certain advantages among which are placing the loading and unloading stations directly opposite one another so that the former is readily accessible alongside the conveyor as shown, the obvious advantage of being able to utilize commercially available subassemblies like drive mechanism 104, and just having an extra station available in case some further operation needs to be performed such as, for example, cleaning or perhaps applying a release agent to the pick-up elements 140 on the mandrel ends preparatory to loading the inserts 76 thereon.

Continuing with reference to FIGS. 3, 11 and 12, in both the loading and unloading operations performed at stations 1 and 3, respectively, (FIG. 12) the mandrels are actuated into extended position without being rotated, whereas, at gluing station 2, they are merely rotated while remaining in retracted position. Extension and retraction of the mandrels is accomplished by double-acting pneumatic servomotors 142 and 144 while rotation thereof is accomplishd by means of a conventional single revolution motor drive 146 such as the one made by Versa Industries and sold as its Motor Drive Assembly Model VK1-3221. Spring 138 is not relied upon to return the mandrel subassembly to retracted position shown in FIG. 13 while at one of the stations although it could, of course, perform such a function. Instead, this spring merely maintains the mandrels in fully-retracted position for engagement with the two-part couplings 148 that are used to both reciprocate and rotate them as they move between stations. While the springs do, of course, assist the servomotors in the retraction stroke, the motors operate much more quickly and positively thus enabling the turret to move on to the next operation.

With specific reference to FIGS. 13, 16 and 17, it will be seen that shaft 132 of the mandrel subassembly carries, in addition to sprocket 130, the driven element 150 of two-part coupling 148 while the shaft 152 of single revolution motor 146 or, alternatively, the piston rod 154 of servomotor 142 or 144 carries the drive element 156. The driven element 148 is affixed to shaft 132 by a set screw 158 (FIG. 16) and it is shaped to provide a pair of outwardly-facing parallel channels 160 on opposite sides thereof positioned and adapted to receive the inturned flanges 162 of the drive element 156 and form a driving connection therewith. These interlocking channels and flanges parallel the plane of turret travel. Moreover, the slot 164 between the flanges of the drive element (FIG. 16) is always aligned when at rest with the circle defined by element 150 with which it interlocks. In other words, the piston rod 154 of servomotors 144 and 146 is secured against rotational movement so that the slot 164 in drive element 156 can remain thus aligned. In a similar manner, motor shaft 152 of single revolution motor 146 always stops in this selfsame position.

The alignment of the channels 160 in the driven element 150 carried by the mandrel subassembly is determined by the position the drive element 156 occupies when it comes to rest after completing the operation performed at a particular station. In other words, once the gluing operation has been completed at station 2 and motor 146 has completed its single revolution, drive element 156 will leave driven element 150 aligned with its channels 160 extending more or less radially with respect to the axis of turret rotation defined by shaft 88 as shown in FIGS. 13, 16 and 17 so that it can enter the slot 164 in the drive element at the next station, specifically, that carried by the piston rod of servomotor 144. The orientation of channels 160 relative to the remainder of the mandrel subassembly 114 is not, of course, controlled by drive element 156, but instead by mounting plate 112 which, in turn, is attached to the turret. Plate 112 holds mandrels 118 in a position such that their axes lie in a plane perpendicular to the axis of turret rotation and tangent to circle defined by the mandrel subassemblies as they rotate therewith.

Drive element 156 is shaped to define a downwardly-opening channel 166, the spaced substantially parallel side flanges 168 of which terminate at their free edges in the coplanar inturned flanges 162. The latter flanges preferably have the corners 170 thereof rounded off as shown to cooperate with the similarly rounded surfaces 172 on the hub 174 of the driven element to cam same into interlocked engagement with one another, all of which has been shown in FIG. 16.

In FIGS. 1, 3 and 12 it will be seen that as the turret 110 rotates each mandrel subassembly 114, in turn, to station 1, servomotors 142 are actuated to extend the mandrels 118 to retrieve a pair of inserts 76 on the pick-ups 140 from a magazine of some sort 174. Some type of pusher assembly (not shown) would be employed to either advance the whole magazine or the contents thereof at the completion of each loading cycle to place a new pair of inserts in the path of the pick-ups 140 of the trailing mandrel subassembly. Such feeds are old in the packaging art per se, and they form no part of the present invention. The inserts could, of course, be loaded on the mandrels by hand although this is impractical on a high speed can line.

Figure 22:
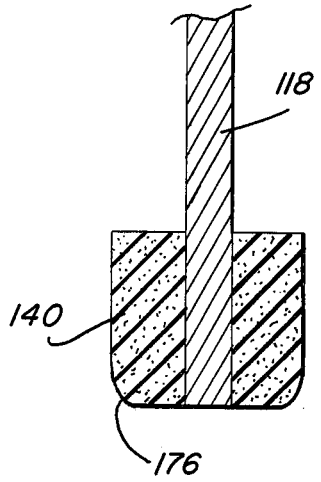
FIG. 22 is a fragmentary elevation to the same scale as FIGS. 20 and 21 showing the mandrel and pick-up head alone.
Figure 21:
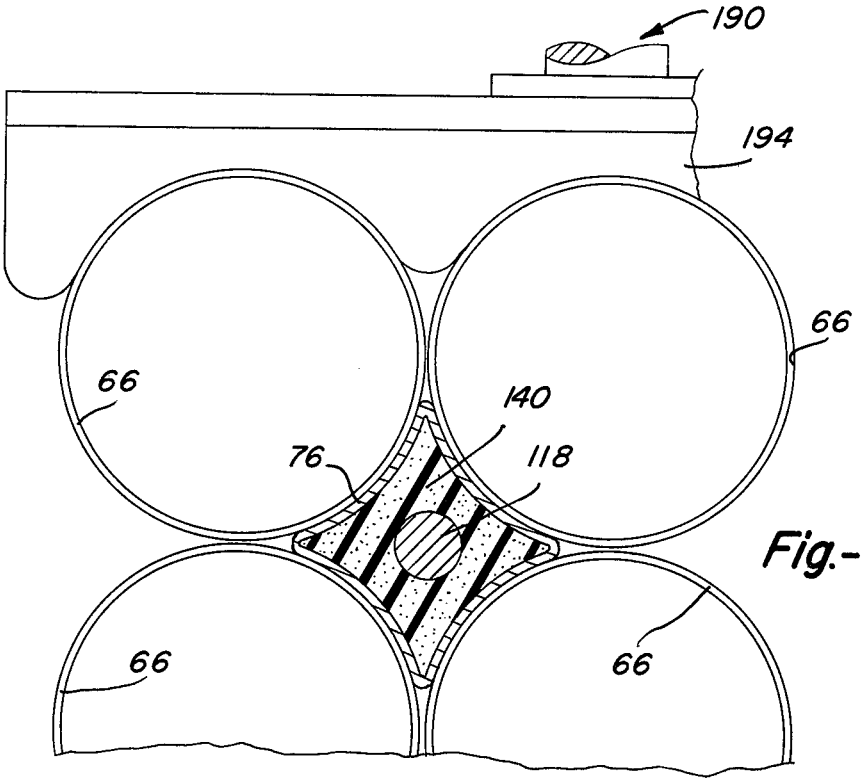
FIG. 21 is a view like FIG. 20 showing the same four cans in closed array.

The significant thing to be noted about the loading operation performed at station 1 is that the pick-up heads 140 are compressible cubes of sponge-like material that are merely shoved by the mandrels down into the open rectangular inserts which are then frictionally retained thereby. As shown in FIG. 22, the bottom edges 176 of the pick-up heads are rounded slightly to facilitate entry thereof into the inserts. These pick-ups are preferably not tapered, but rather, have a more or less cubical shape so that when compressed as shown in FIG. 21, they will exert a substantially uniform outward force upon the insert to press same against the cylindrical can wall. A tapered unit would, of necessity, exert a reduced pressure in the areas of smaller cross section where the spongy material is less compressed.

Once the inserts have been loaded onto the pick-ups 140 at station 1 and the servomotors 142 have completed their operating cycle returning the mandrels to fully retracted position, the turret or turrets 110, depending upon whether one or two sets of inserts are used, will index to the second station. As this occurs, coupling 148 at station 1 will uncouple and driven element 150 thereof will swing around on the turret with its mandrel subassembly until it enters the slot 164 in the drive element 156 carried on the shaft 152 of single revolution motor 146 thus forming another driving connection therewith. Simultaneously, the driven element on the mandrel subassembly that formerly occupied the vacant station 4 will move into interlocked engagement with the drive element on the piston rod of servomotor 142 located at the loading station. The driven element leaving gluing station 2 will, of course, link up with the drive element carried by the piston rod of servomotor 144 at the unloading station 3.

Looking next at FIGS. 1–4, 7 and 12–14, the gluing operation that takes place at station 2 will be described. Mounted alongside the mandrels when they arrive at station 2 is a glue dispensing subassembly that has been indicated broadly by reference numeral 178. A reservoir 180 located either at station 2 or some remote location and connected thereto by suitable glue transfer lines 182 (see FIG. 3) delivers a specially formulated quick seting hot melt glue to the glue dispensers 184 in molten form. Reservoir 180 is electrically heated and the temperature of the glue is thermostatically controlled. The same is true of the dispensers 184, reference numeral 186 indicating the heaters. A suitable pump 188 (FIG. 3) is used to transfer the glue from the reservoir to the dispensers.

No attempt has been made to illustrate the details of construction of glue dispensers 184 because, in and of themselves, they form no part of the present invention. Their function in the combination is to dispense a measured quantity of the glue 186 onto all four sides of the exterior surface of each insert 76 during the precise time interval required for single revolution motor 146 to turn them completely around and, as such, the design of a dispenser meeting these requirements is well within the skill of the art. The temperature of the glue must, of course, be carefully controlled as it issues from the dispensing nozzles 188 for two important reasons. The first of these is to have the glue issue forth at a consistency where it will adhere to the surfaces of the can and the insert while, at the same time, remaining viscous enough to form a bead around the latter that will not run or drip on either of these surfaces. The second requirement is, of course, to provide maximum holding power in the shortest possible setting time so as to maximize the output of the pckaging apparatus.

The dispensing and mandrel revolution cycles are, of course, initiated simultaneously and automatically the instant the mandrel subassembly arrives at station 2. Here again, such controls as well as the timing cycle are well within the skill of the ordinary artisan and no useful purpose would be served by going into these aspects of the apparatus in detail, it being sufficient to note that provision is made for them along with varying such parameters as temperatures, speeds, cycling intervals, etc. to accommodate anomalies that are bound to crop up from time to time in a process of this nature.

Figure 5:
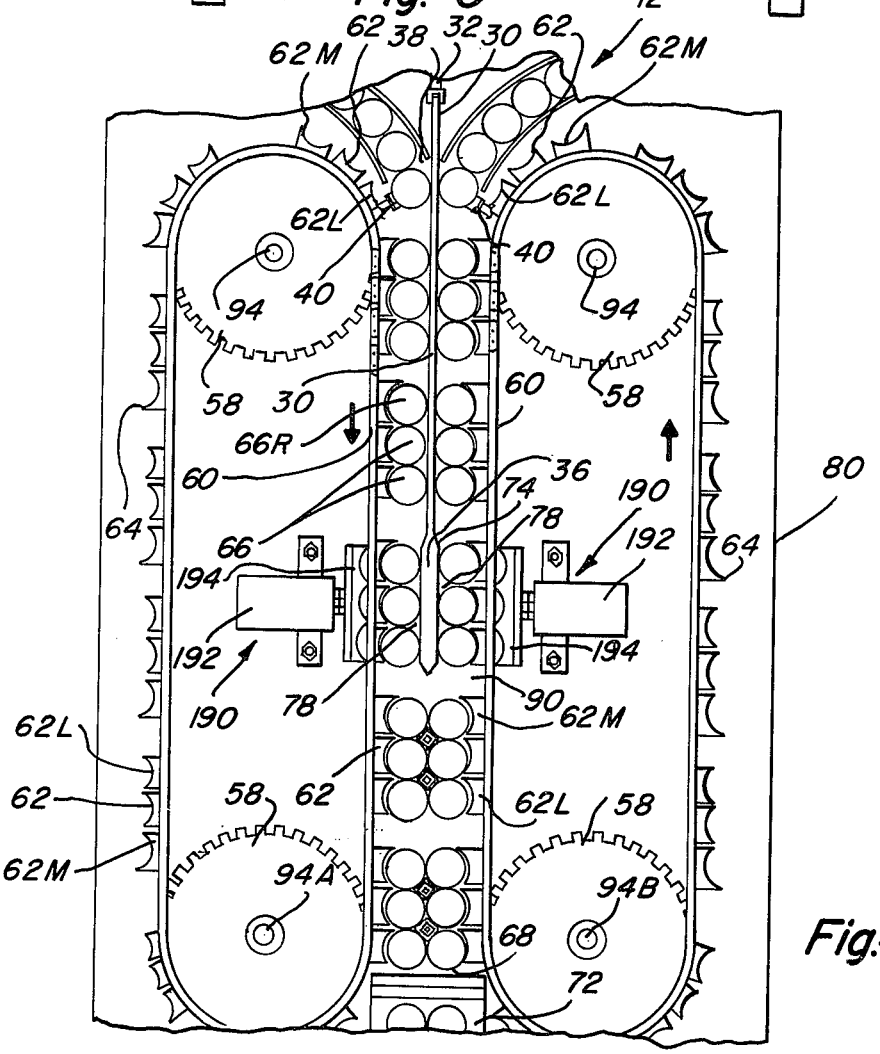
FIG. 5 is a fragmentary sectional view similar to FIG. 1, but to an enlarged scale taken along line 5—5 of FIG. 3.
Figure 10:
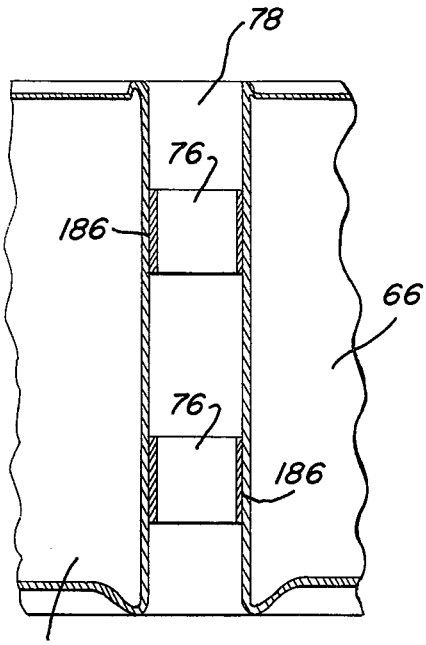
FIG. 10 is a section taken along line 10—10 of FIG. 9 and to the same scale as the latter.

Once the glue has been applied to the inserts on all four sides, the turrets index them to the third station where the actual packaging operation takes place, the latter having been illustrated in FIGS. 5, 9–12 and 18–21 to which detailed reference will next be made. As the glue-coated inserts are moved to station 3, a set of six cans will arrive on the conveyor loops and be stopped there in open array as shown in FIGS. 1, 5 and 12. The two groups of three aligned cans will be forced into maximum transversely-spaced relation by spacer 36 and left in this position when it is retracted just prior to actuating servomotors 144 to move the inserts into position therebetween. It would, of course, be possible to leave the spacer 36 in place while the inserts are being introduced between the cans; however, no useful purpose would be served by doing so when there are no forces acting to close the gap between the groups of cans at this point. Also, the spacer must eventually be retracted so that the pusher subassemblies that have been broadly indicated by numeral 190 can be actuated to move the cans into closed array.

Referring briefly to the diagram of FIG. 11, it will be seen that upon arrival at the unloading station 3, the mandrel subassemblies 114 initially occupy the fully retracted positions shown at the left; however, immediately upon actuation of servomotor 34 to retract the spacer, servomotors 144 actuate to extend th mandrels and introduce the precoated inserts into proper position between the groups of cans while they remain in maximum transversely-spaced relation. It should be noted in connection with FIG. 13 that as the mandrels 118 extend, shaft 132 extends also. At this stage in the unloading cycle, the groups of cans are still spaced apart far enough to receive shaft 132 therebetween; however, as will appear presently, pusher subassemblies 190 are actuated to close the array and move the groups into the side-by-side contacting relation shown most clearly in FIGS. 1, 5, 12 and 21 before the mandrels are retracted; therefore, since shaft 132 would prevent the middle cans of each group from moving into side-by-side relation, the length of shaft 132 is selected such that it will not enter the space between the can groups when the inserts are located in proper position therebetween. Actually, bushing 134 on the underside of the yoke 124 acts as a stop contacting the upper surface of plate 112 to limit the excursion of the mandrels into their extended positions.

Once the mandrels have been actuated into their extended positions shown at the right in FIG. 11, they remain thus extended while servomotors 192 of the pusher subassemblies 190 are actuated to extend pushers 194. These pushers are shaped to conform to the convex cylindrical surfaces of the three can groups and move them away from the conveyor saddles 62 into side-by-side contacting relation. One such pusher subassembly 190 is located on opposite sides of the six can array and they are actuated simultaneously so as to not force the mandrels to one side or the other. As the pushers move into extended position, they squeeze the four can subgroups against the insert causing both it and the sponge-like pick-up 140 therebehind to deform into the distorted shape shown in FIG. 21. The outwardly-directed forces exerted by the compressed pick-ups urge the walls of the inserts into tight concave engagement with the convex cylindrical can walls thus spreading out the ribbon or bead of glue and providing an area of contact that extends around the can approximately a sixth of its circumference. The elements remain in this compressed mode shown in FIGS. 12 and 21 until such time as the glue has set and a bond has been established between the insert and cans whereupon, before the pushers 194 are retracted, servomotors 144 are actuated to raise the mandrels into retracted position thus stripping or "unloading" the inserts therefrom. The back up and pressure provided by the compressed pick-ups 140 are no longer needed because the inserts remain in their distorted shape bonded to the adjacent can surfaces so, not only the mandrels can be retracted, but the pushers as well. This completes the combined compression and unloading cycle as well as the packaging operation itself. The next step is to reactivate the conveyor subassembly to move the finished six-pack 70 off into discharge conveyor 72 while, at the same time, extending the spacer 36 and moving two new groups of three cans into station 3. Simultaneously, of course, a new set of inserts will be loaded at station 1 and the set just loaded will be getting their coating of glue at station 2.

What is claimed is:

1. The improved method for assembling and joining an even number of four or more like cans together to form a unitary package which comprises the steps of: assembling the cans in two lines alongside one another, releasing the same number of cans greater than one from each line, picking up the cans thus released and collecting those from each line into a longitudinally aligned row, placing the rows in transversely-aligned side-by-side spaced relation, inserting an adhesive coated bendable ring vertically into the space between each group of four cans while yieldably supporting said ring from the inside, closing the rows to eliminate the space therebetween while using the four cans of each group to press the ring against the yieldable support therefor and reshape said ring to conform with the cylindrical can wall surfaces pressing thereagainst, maintaining the groups thus closed until the adhesive sets, and extracting the yieldable supports from within the reshaped rings to strip the latter therefrom.

2. The improved method as set forth in claim 1 wherein the cans are released from each line simultaneously.

3. The improved method as set forth in claim 1 wherein the assembly of the row and the joining thereof into the unitary package is carried out while the cans are stopped.

4. The improved method as set forth in claim 1 which includes the steps of detachably mounting the rings on the yieldable supports and rotating said supports past a source of adhesive while simulaneously dispensing said adhesive onto said ring.

5. The improved method as set forth in claim 4 wherein the supports are rotated one complete revolution and said adhesive is dispensed during said entire revolution so as to coat the ring all the way around.

6. The improved method as set forth in claim 1 which includes the steps of introducing two rings into the space between each group of four cans, one from the top and a second from the bottom.

7. The improved method as set forth in claim 6 wherein the rings are introduced from the top and bottom simultaneously.

8. The improved method for detachably fastening even numbered groups of four or more cylindrical cans together in assembled relation which comprises the steps of: arranging the cans in subgroups of four cans defining an open rectangular array, mounting a deformable ring-like insert on a compressible pick-up member, applying an adhesive coating to the exterior surface of the insert thus mounted, inserting the precoated insert into the center of the open array, closing the array so as to press the adhesive coated exterior surfaces of the insert into concave engagement with the cylindrical can walls as they compress the pick-ups, and stripping the inserts from the pick-ups by withdrawing the latter therefrom once the adhesive has set.

9. The improved method as set forth in claim 8 which includes the step of rotating the pick-up with the insert mounted thereon past a source of adhesive while simultaneously dispensing said adhesive thereon preparatory to introducing the latter into the center of the open array.

10. The improved method as set forth in claim 8 which includes the step of introducing two inserts ito each array, one from the top and a second from the bottom.

11. The improved method as set forth in claim 10 wherein the two inserts are introduced into the array simultaneously.

12. The improved method as set forth in claim 11 wherein the two inserts are placed in vertically-spaced relation, the insert inserted from the top being spaced down from the latter and the insert introduced from the bottom being spaced thereabove.

13. The improved method as set forth in claim 8 wherein the four cans in open array comprise two rows of two cans each, the cans of each row being longitudinally aligned, and the two rows being transversely-aligned in spaced side-by-side relation.

14. The improved method as set forth in claim 11 wherein the cans in each row lie in closed array.

15. The improved method as set forth in claim 8 wherein the adhesive coated insert is introduced vertically into the center of the open array.

16. The apparatus for assembling and joining together an even number of four or more like cylindrically-walled cans to form a unitary package which comprises: means for discharging cans one at a time from each of two side-by-side rows thereof; divider means positioned to receive and maintain the cans discharged from each row in transversly-spaced relation; conveyor means positioned and adapted to receive at least two cans from each row and move them along opposite sides of the divider means in transversely-aligned relation to produce an open array thereof containing at least one four-can subgroup of two cans in each row; carrier means mounted for vertical reciprocating movement between an extended position projecting into the center of a four-can subgroup and a retracted position disengaged therefrom; a compressible jacket carried by said carrier means adapted to detachably retain an adhesive coated bendable ring-like insert in encircling relation thereon, said jacket being deformable to the extent necessary to reshape said insert into concave contacting relation with the cylindrical walls of the associated four-can subgroup when the latter is moved into closed array thereagainst; divider actuating means connected to the divider operative upon actuation to remove the latter from between at least the two cans in each row of one subgroup; carrier reciprocating means connectable to the carrier operative upon actuation in one position to extend the latter and place an adhesive coated insert carried thereby into the center of a subgroup in open array, and said means being operative in a second position to remove the carrier and to strip the insert therefrom after the adhesive as set with said subgroup in closed array; and, pusher means operative upon actuation with the divider removed to engage the cans of a subgroup in open array and move same together into closed array.

17. The apparatus as set forth in claim 16 which includes gate means associated with the discharge means operative to release a selected number of cans from each row to the conveyor means.

18. The apparatus as set forth in claim 17 in which: the gate means are operative to release the same number of cans from both rows simultaneously. thereon

19. The apparatus as set forth in claim 16 in which: adhesive dispensing means is positioned alongside the carrier means in retracted position; and, in which a carrier-rotating means is connectable to the carrier operative upon actuation with the latter in retracted position to turn an insert mounted theron past the adhesive dispensing means while adhesive is applied to said insert.

20. The apparatus as set forth in claim 18 wherein: means comprising a turret is mounted for rotational movement about a vertical axis displaced to one side of the carrier rotating means, said turret carrying at least two of the carrier means in position for successive movement therewith between at least a first and a second position, said turret in first position connecting one of the carrier means to the carrier reciprocating means and another carrier means to the carrier rotating means, and said turret in second position disconnecting said carrier means from the actuating means therefor to which they were connected while connecting other carrier means thereto.

21. The apparatus as set forth in claim 16 wherein the conveyor means comprises a pair of synchronized endless loop conveyors mounted on opposite sides of the divider with a portion of each running parallel to the latter in the same direction and in spaced relation thereto, said conveyors each having appendages thereon shaped and positioned to receive the cans discharged thereto and move selected numers thereof along the divider in fixed spaced longitudinal alignment.

22. The apparatus as set forth in claim 16 in which: the divider actuating means is operative upon actuation in one position to retract the divider in a direction opposite to that in which the conveyor means is moving, said actuating means being effective when so actuated to open the space between one or more selected subgroups for the placement of an insert therebetween while maintaining the transversely-spaced relation between other of said subgroups upstream.

23. The apparatus as set forth in claim 22 in which: said divider actuating means is shaped to engage a pair of cans in side-by-side relation and force them apart, said divider actuating means being operative in a second position to place a group of cans leaving the can discharging means in open array.

24. The apparatus as set forth in claim 22 in which: the divider actuating means comprises a piston servomotor operative to reciprocate same.

25. The apparatus as set forth in claim 16 in which: the carrier includes a pair of jacketed insert-carrying members arranged in opposed coaxial relation, one member of said pair being operative upon actuation into extended position to enter the center of the subgroup from above while the other member of said pair is similarly operative to enter same from the bottom.

26. The apparatus as set forth in claim 25 wherein: said pair of jacketed insert-carrying members cooperate in extended position to place a pair of inserts in vertically-spaced relation between the cans of the four-can subgroup, the lower member of the pair placing the insert carried thereby in spaced relation above the bottom of the cans while the upper member thereof places its insert in a similar position relative to the top of the cans.

27. The apparatus as set forth in claim 16 in which: the pusher means comprises a pair of can-engaging shoes and servomotors operatively connected thereto for extending and retracting them, said shoes being positioned in opposed transversely-spaced relation to one another alongside the conveyor, and said shoes being so arranged relative to the conveyor means as to pass over the top thereof and remove the cans therefrom upon actuation into extended position.

28. The apparatus as set forth in claim 16 wherein: means comprising a turret is mounted for rotational movement about a vertical axis displaced to one side of the carrier reciprocating means, said turret carrying at least two of the carrier means in position for successive movement therewith between at least a first and a second position, said turret in first position connecting one of the carrier means to the carrier reciprocating means, and said turret in a second position thereof connecting a second carrier means to said carrier reciprocating means.

29. The apparatus as set forth in claim 28 in which said turret has a third position wherein a third carrier means is connected to the carrier reciprocating means, a previously stripped carrier means is being fitted with an insert, and a carrier means with an uncoated insert mounted thereon is being coated with adhesive.

* * * * *